United States Patent [19]

Kozar

[11] 4,256,578

[45] Mar. 17, 1981

[54] WASTE OIL RECOVERY PROCESS

[75] Inventor: Robert S. Kozar, Livonia, Mich.

[73] Assignee: AMSTED Industries Incorporated, Chicago, Ill.

[21] Appl. No.: 98,547

[22] Filed: Nov. 29, 1979

[51] Int. Cl.[3] ..... C10M 11/00

[52] U.S. Cl. ..... 210/766; 210/765; 210/774; 208/183; 210/804

[58] Field of Search ..... 208/183, 179; 210/59, 210/60, 43, 65, 73 W, 71, 83

[56] References Cited

U.S. PATENT DOCUMENTS

| | | | |
|---|---|---|---|
| 2,284,106 | 5/1942 | Stagner | 208/183 |
| 2,902,439 | 9/1959 | Milz et al. | 208/183 |
| 3,304,255 | 2/1967 | Katsuta et al. | 208/183 |
| 3,793,184 | 2/1974 | Loftus | 208/183 |

*Primary Examiner*—Benoit Castel

*Attorney, Agent, or Firm*—John L. Schmitt; Fred P. Kostka; Edward J. Brosius

[57] ABSTRACT

Oil, used as a lubricant and coolant in an industrial process, may become contaminated by foreign materials, for example, water and solid particulate. Because of its cost, continued use of the oil is desirous but impossible if the foreign materials are not removed when the concentration of such becomes excessive. By heating the contaminated oil and adding a chemical agent such as an alkaline solution of sodium metasilicate, the oil may be selectively separated from its contaminants allowing its further use.

1 Claim, 1 Drawing Figure

WASTE OIL RECOVERY PROCESS

BACKGROUND OF THE INVENTION

1. Field of the Invention.

This invention relates generally to separating processes wherein a liquid based mixture may be divided into distinct phases to allow selective processing of each such phase. More particularly, this invention relates to treating oil which has become contaminated during use in an industrial process. By being able to remove the contaminants from the oil, the oil may be returned to the industrial process for reuse.

2. Prior Art

Separating processes applicable to liquids as well known and may be divided into three general categories. A first category includes mechanical means in which physical properties are considered. For example, a filter media may be used to retain solid particulate in the liquid as it flows through the filter media.

Where the particle size of the particulate is generally submicronic, mechanical filtration is impractical because an extremely tight filter septum is required to effect separation. Such a septum rapidly blinds off, resulting in short filter cycles and high media usage.

Another means of separation is by settling. However, where the particulate size is small and the difference in specific gravity of the liquid and particulate is not substantial, the particulate tends to stay in suspension. Under these conditions, separation may take days. Centrifugal separation can also be used but extremely high rotational speed can be required.

Other separating methods include magnetic separators, electromagnetic devices, electrophoresis, electrostriction and electrostatic separation. All of these means are expensive and produce questionable results.

Another such process relying on physical properties for separation is disclosed in U.S. Pat. No. 3,637,490. This reference suggests that waste solids may be separated from industrial or municipal waste water by allowing microballoon like objects made of a film forming agent to float upwardly through the waste water. The waste solids adhere to the surface of the objects and accumulate on a top surface of the waste water to form a scum which may be readily removed.

A second general category of liquid separating processes are ones in which chemical properties are considered. One such example is disclosed in U.S. Pat. No. 2,980,608 wherein a flocculating agent is added to waste water to improve the separation of suspended solids in the waste water.

Another example of chemical separation is disclosed in U.S. Pat. No. 1,727,165 wherein an oil-water emulsion is treated with a surface tension depressant such as an oil soluble mineral oil-sulphuric acid salt to cause the water and oil to separate into distinct phases.

A third general category of separating processes relies on both physical and chemical properties to achieve its intended purpose.

SUMMARY OF THE INVENTION

Oil used in an industrial process may come in contact with various foreign materials such as water and solid particulate such as metallic fines and oxides. As use of the oil continues, the amount of foreign material in the oil gradually increases in concentration. When the oil is sufficiently contaminated with these foreign materials, the oil can no longer be used and must either be discarded or cleaned.

Removal of the foreign material may be accomplished by first heating the contaminated oil and then adding a controlled amount of a chemical reagent such as a dilute alkaline solution. The solution and the contaminated oil react such that the reacted mixture separates into an oil phase and an aqueous phase.

The oil phase may be readily decanted from the aqueous phase, filtered and returned to the industrial process for further use. The aqueous sludge phase may be dewatered by mechanical filtration leaving a residue of solid particulate which may be disposed of accordingly. The aqueous phase contains the chemical reagent which may be reused after filtration.

The above-noted separating process offers several important advantages over other known procedures. First, the process provides a ready means of rejuvenating contaminated oil to allow its reuse. Thus, this important cost factor may be held to a reasonable level. Additionally, by being able to reuse the oil, there is no need for its disposal. Considering the problems and cost of disposing of waste in an environmentally acceptable manner, reuse of the oil thus provides a second cost benefit.

Secondly, the aqueous phase is further divided into a reusable chemical reagent and metallic compounds. The metallic compounds in turn may be used in a further industrial process as a reusable solid waste.

Thus, by this inventive separating process, an unusable oil mixture may be separated into its usable parts.

DESCRIPTION OF THE PREFERRED EMBODIMENT

Figure 1:
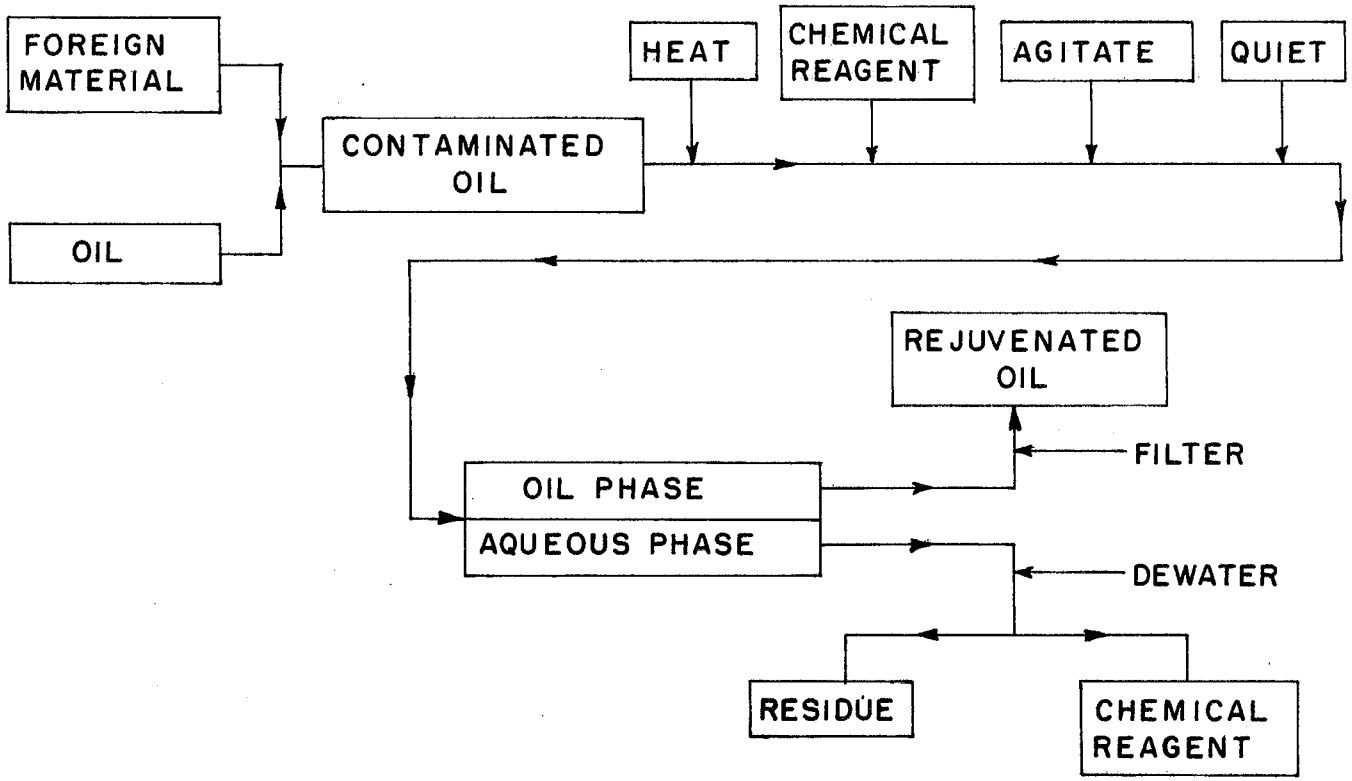
FIG. 1 is a schematic flow diagram of the process of this invention.

An industrial process, for example aluminum foil manufacture, uses oil as a lubricant and coolant as aluminum sheet is reduced to foil thickness in a series of rolling operations. During these rolling operations, the oil comes into contact with various foreign materials such as water, aluminum and aluminum oxide fines which join with the oil to form a mixture.

As the foil manufacture continues, the concentration of foreign materials in the oil increases to a point where the oil becomes sufficiently fouled to be unusable. This contaminated oil must then be discarded or cleaned to make such reusable.

To facilitate cleaning, i.e. separating the foreign materials from the oil, the contaminated oil is first heated to a temperature of proximately 140° F. Depending on the exact nature of the oil and the foreign materials, temperatures as high as 160° F. have also proved effective. With the contaminated oil heated to the required temperature, an alkaline solution proximating 10 percent of sodium metasilicate is added to the heated oil in an amount of proximately 10 percent by volume of the oil.

The alkaline solution and the oil are then agitated for about 15–20 minutes to insure a thorough dispersion of the alkaline solution throughout. This agitation also insures that contaminated oil mixture chemically reacts with the alkaline solution.

The reacted mixture is then allowed to quiet for proximately 30 minutes wherein the mixture separates into an upper oil phase and a lower aqueous phase. By decanting, the oil phase may be drawn off and filtered.

The oil has now been rejuvenated and is ready to be reused.

The aqueous phase is further processed by dewatering such by mechanical filtration to produce partially reacted and substantially reusable alkaline solution and a residue comprising predominantly aluminum fines and aluminum silicates.

A similar procedure has been applied to oils used in an electrical discharge machining operation with promising results.

In the chemical reaction noted above, hydrogen gas is produced in limited amounts which may be disposed of by a number of known ways, for example, simply venting into the atmosphere.

Alkaline materials other than sodium metasilicate are usable and may include sodium hydroxide, potassium hydroxide and calcium hydroxide. While the other materials are available, their use has the disadvantage of producing more hydrogen gas and the aqueous phase produced by such has proved more difficult to dewater because of a high concentration of aluminum hydroxide.

While various modifications may be suggested by those versed in the art, it should be understood that I wish to embody within the scope of the patent warranted hereon, all such modifications as reasonably and properly come within the scope of my contribution to the art.

What is claimed is:

1. In an industrial metal manufacture such as aluminum processing wherein oil is used as a lubricant and coolant during said processing with said oil becoming contaminated with produced metallic fines and other foreign materials so as to be unusable, an improved process of rejuvenating said contaminated oil comprising the steps of:

(1) preparing a dilute alkaline solution using about nine parts of water and one part of sodium metasilicate, (2) heating said contaminated oil to a temperature range of about 140° F. to about 160° F., (3) adding said alkaline solution to said heated oil in an amount of about 10% by volume of said contaminated oil, (4) agitating said heated contaminated oil and said alkaline solution for about 15–20 minutes to cause a thorough intermixing thereof to insure a substantially complete reaction therebetween to produce a reacted mixture, (5) quieting said reacted mixture for about 30 minutes to allow a phase separation comprising an upper oil phase and lower aqueous phase, (6) decanting said oil phase from said aqueous phase, (7) filtering said oil phase to produce rejuvenated oil reusable in said manufacture, and (8) dewatering said aqueous phase to produce a substantially reusable alkaline solution and a residue comprising said metallic fines, metallic silicates, and traces of foreign materials.

* * * * *